US007740416B2

(12) United States Patent
Lesche

(10) Patent No.: US 7,740,416 B2
(45) Date of Patent: Jun. 22, 2010

(54) TAMPER DEVICE WITH REPLACEABLE TOOL HEAD ASSEMBLY

(76) Inventor: Peter W. Lesche, 1220 Grissel Dr., Millville, NJ (US) 08332

( * ) Notice: Subject to any disclaimer, the term of this patent is extended or adjusted under 35 U.S.C. 154(b) by 72 days.

(21) Appl. No.: 12/148,609

(22) Filed: Apr. 21, 2008

(65) Prior Publication Data

US 2009/0214295 A1 Aug. 27, 2009

Related U.S. Application Data

(60) Provisional application No. 61/067,123, filed on Feb. 26, 2008.

(51) Int. Cl.
*E01C 19/32* (2006.01)
*E01C 19/35* (2006.01)
*E01C 19/30* (2006.01)

(52) U.S. Cl. ..... 404/133.1; 404/133.05

(58) Field of Classification Search ..... 404/133.05, 404/133.1, 133.2

See application file for complete search history.

(56) References Cited

U.S. PATENT DOCUMENTS

| | | | | | |
|---|---|---|---|---|---|
| 1,730,393 | A * | 10/1929 | Stevens | 164/169 |
| 1,757,562 | A * | 5/1930 | Fey | 425/469 |
| 2,659,281 | A * | 11/1953 | Lucas | 404/133.1 |
| 2,746,367 | A * | 5/1956 | Ferguson | 404/133.1 |
| 3,091,159 | A * | 5/1963 | Miller | 404/133.2 |
| 3,847,498 | A * | 11/1974 | Grane et al. | 404/133.1 |
| 4,996,925 | A * | 3/1991 | Biermann | 104/10 |
| 5,261,762 | A * | 11/1993 | Yamaguchi | 404/133.05 |
| 5,261,763 | A * | 11/1993 | Crowell | 404/133.05 |
| 6,000,879 | A * | 12/1999 | Greppmair | 404/133.1 |
| 6,302,622 | B1 * | 10/2001 | Nagasawa | 404/133.1 |
| 6,394,697 | B1 * | 5/2002 | De Boer | 404/133.1 |
| 6,409,426 | B1 * | 6/2002 | MacLellan | 404/133.1 |
| 7,316,524 | B1 * | 1/2008 | Pikuet | 404/133.1 |
| 7,387,466 | B2 * | 6/2008 | Irwin | 404/133.1 |
| 2002/0051682 | A1 * | 5/2002 | Gevik et al. | 404/133.05 |
| 2002/0141825 | A1 * | 10/2002 | Kurten | 404/133.05 |

* cited by examiner

*Primary Examiner*—Thomas B Will
*Assistant Examiner*—Abigail A Risic
(74) *Attorney, Agent, or Firm*—Stuart M. Goldstein

(57) ABSTRACT

A hand or mechanically powered tamper tool which has a removeable, replaceable, tool head assembly. The tool head assembly is a separable component from the upper section of the tamper tool which consists of the mounting plate and its attached tamper handle. The tool head assembly has a rubber or similarly resilient material pad bonded to the underside of a backing plate. Connection elements, such as bolts, are permanently secured between the pad and the backing plate. The bolts extend through and are upstanding from the backing plate. The bolts are configured to then extend through openings in the tamper mounting plate, where nuts are used to secure the tool head assembly to the mounting plate. The tool head assembly is thus removeable from the mounting plate and its handle or supporting element and allows for the simple and ready replacement of a used and worn tool head assembly with a new tool head assembly.

16 Claims, 4 Drawing Sheets

TAMPER DEVICE WITH REPLACEABLE TOOL HEAD ASSEMBLY

This application claims the benefit of provisional application Ser. No. 61/067,123, filed on Feb. 26, 2008.

BACKGROUND OF THE INVENTION

The invention relates to the field of unique hand and mechanically powered plate type tools known as tampers used for tamping down and compacting soil/aggregate in bed preparation and in setting concrete pavers placed thereon. They are effective in leveling soil surfaces and compacting pavers into proper position in the ground. The invention also relates to powered tampers, commercially known as Jumping Jacking plate tampers, also used for compacting soil, asphalt and similar surfaces. Tampers are routinely used by gardeners, landscapers, nurserymen, hardscapers, contractors, road builders, farmers, and like workers.

It has been found that under normal usage of both steel faced manual and powered tamper tools, the hard face of the plate of the tamper sometimes breaks and often causes damage to the pavers being placed, such that replacement of pavers becomes necessary. This problem is currently being addressed by bonding a rubber face directly onto the plate steel face of the tamper. The rubber face serves to cushion tamping efforts. Unfortunately, rubber faces, in time and after even less than prolonged usage, will delaminate or otherwise separate from the plate steel facings, resulting in costly tool repairs or component replacement, or disposal of the tool itself.

SUMMARY OF THE INVENTION

It is thus an object of the present invention to overcome the disadvantages and limitations of prior steel faced hand and mechanically powered tampers.

It is an object of the present invention to provide a tamper which has a cushioned face which, when the face is worn or falling off, can be replaced without having to replace the tamper itself.

It is another object of the present invention to provide a tamper which will eliminate the need to replace the tool when the face of the tamper is damaged during use.

It is still another object of the present invention to provide a tamper which can be repeatedly used without damage either to the face of the tamper or the paver or other surface on which the tamper is used.

It is a further object of the present invention to provide a tamper which has a removeable tool head assembly which, when used, can be replaced with a new head assembly.

It is another object of the present invention to provide a tamper which has a removeable tool head assembly with a rubber or other resilient pad, presenting a cushioned tamper face which is completely flat with no openings or fasteners on the surface of the face.

It is an additional object of the present invention to provide a tamper with a removeable tool head assembly which is easier and less costly than repairing tampers with direct steel face to resilient pad bonding.

It is another object of the present invention to provide a tamper which is not only easy and relatively inexpensive to manufacture, but also conserves natural resources in that less metal material is used to construct the tool head of the tamper and in that tamper tools will need to be replaced less often.

These and other objects are accomplished by the invention, a hand or mechanically powered tamper tool which has a removeable, replaceable, tool head assembly. The tool head assembly is a separable component from the upper section of the tamper tool which consists of the mounting plate and its attached tamper handle. The tool head assembly has a rubber or similarly resilient material pad bonded to the underside of a backing plate. Connection elements, such as bolts, are permanently secured between the pad and the backing plate. The bolts extend through and are upstanding from the backing plate. The bolts are configured to then extend through openings in the tamper mounting plate, where nuts are used to secure the tool head assembly to the mounting plate. The tool head assembly is thus removeable from the mounting plate and its handle or supporting element and allows for the simple and ready replacement of a used and worn tool head assembly with a new tool head assembly.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
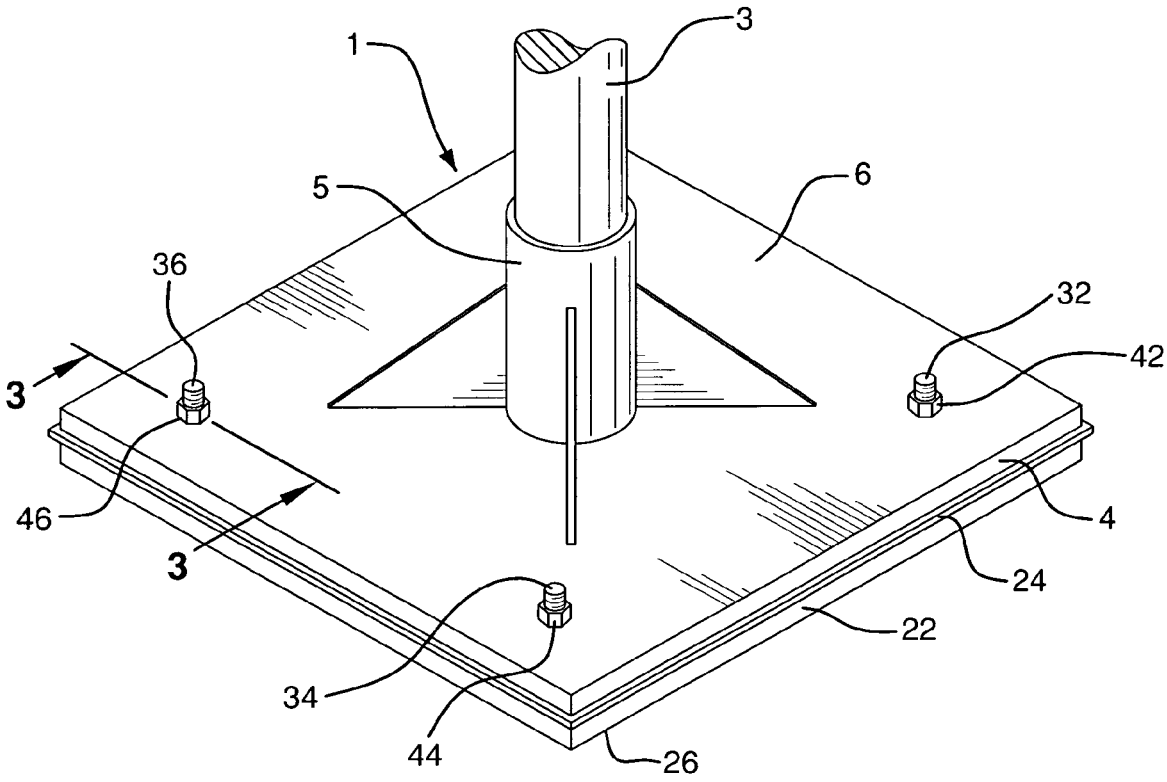
FIG. 1 is an isometric view of the present invention.

Tamper tool 1 comprises upper section 2 comprising handle 3 secured to and extending perpendicularly up from mounting plate 4 via support 5. Mounting plate 4, a standard steel tamper plate member, is flat and has top surface 6 and bottom surface 8. Openings 10, 12, 14, and 16 extend through mounting plate 4.

Tool head assembly 20, a separate and independent component, comprises rubber pad 22 and metal backing plate 24. Pad 22 can be made of any relatively hard, yet resilient material. Pad 22 has flat, lower surface 26, which contacts the paver or other ground surface on which tamper tool 1 is used, and upper surface 28, which is permanently bonded with suitable adhesive 27 to backing plate 24. Threaded bolt connectors 30, 32, 34, and 36 extend from adhesived upper surface 28 of pad 22, through backing plate 24. It is contemplated that the bolt connectors will be permanently fastened by welding, threads, knurl, or equivalent attachment method, to backing plate 24, prior to the bonding of pad 22 to the backing plate. By this configuration, connectors 30, 32, 34, 36 are fixedly upstanding from tool head assembly 20 and lower surface 26 of pad 22 remains a flat, planar surface, uninterrupted by openings, bolt heads, or similar intrusive elements. Thus, when tool 1 is employed to tamp down pavers and like materials, contact is made solely with the smooth flat, resilient uninterrupted surface provided by lower surface 26 of pad 22.

For connection between upper section 2, and specifically mounting plate 6, to tool head assembly 20, these components are positioned such that connectors 30, 32, 34, and 36 are aligned beneath openings 10, 12, 14, and 16, respectively, of the mounting plate. The connectors are then inserted into the openings where they are secured by nuts 40, 42, 44, and 46 with threads corresponding to the threaded bolt connectors. Tamper tool 1 is now ready for use. Again, the resilient, relatively cushioning nature of pad 22, will serve to prevent breakage or other damage to pavers or similar ground surfaces, when tamper tool is being used.

After prolonged usage of tamper tool 1, pad 22 will likely become materially scarred and worn. Nuts 40, 42, 44, and 46 are removed from bolt connectors 30, 32, 34, and 36 and tool head assembly 20 is separated and removed from upper section 2 and mounting plate 6. A replacement tool head assembly with a new rubber pad can be attached, via its bolt connectors, to mounting plate 6, to allow the tamping operation to proceed.

The inventive concept of the present invention is equally applicable to mechanically powered hand controlled tampers, commonly known as "Jumping Jacks" plate tampers. These pieces of equipment are most often used on large commercial projects, where asphalt or great quantities of soil must be compacted. Like hand tampers, powered tampers' pads and their working faces become worn over time. This requires replacement of the entire lower base component of the tamper, an expensive proposition. However, the present invention also addresses this problem and its attendant expense.

Figure 2:
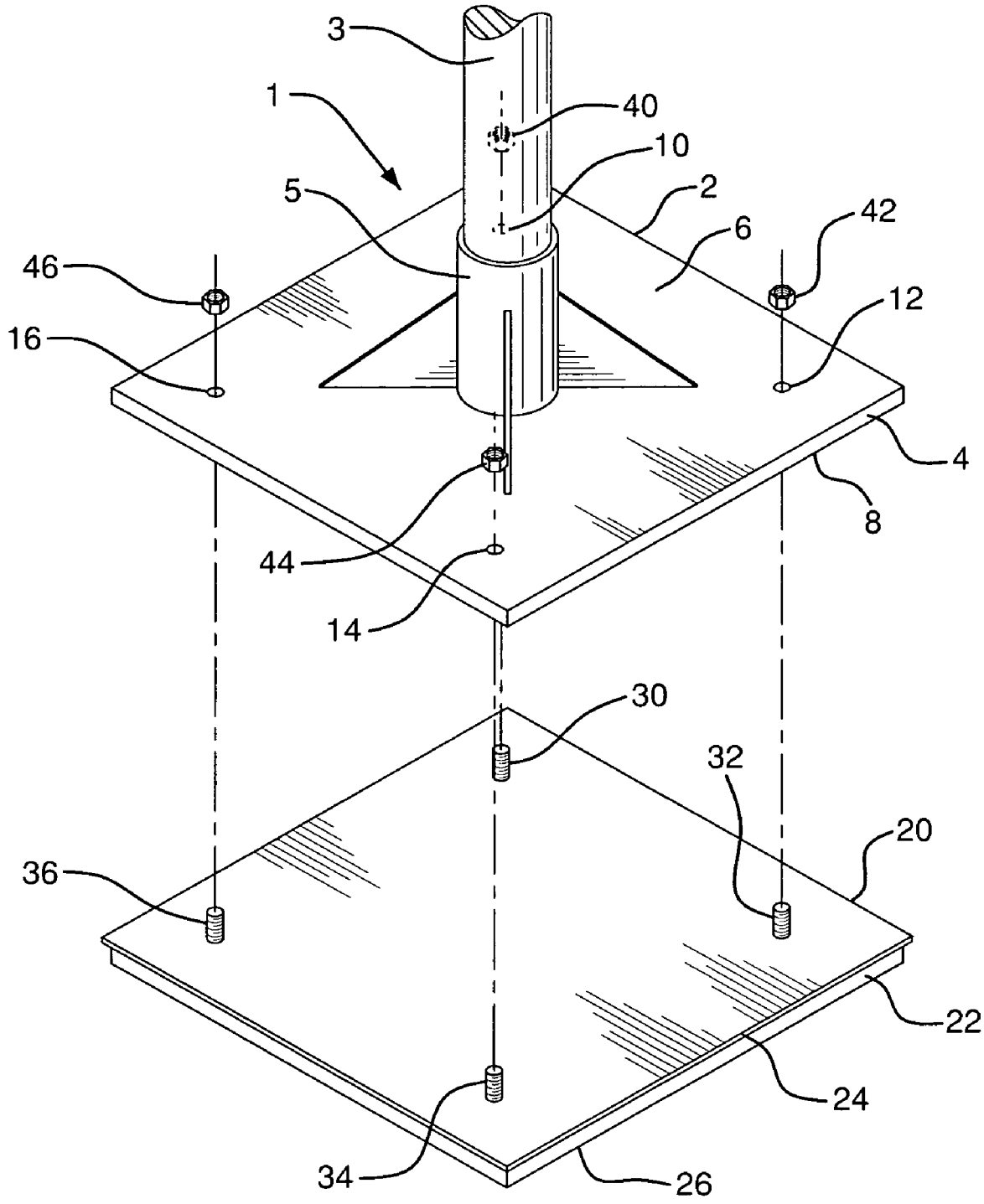
FIG. 2 is an exploded isometric view of the present invention.
Figure 3:
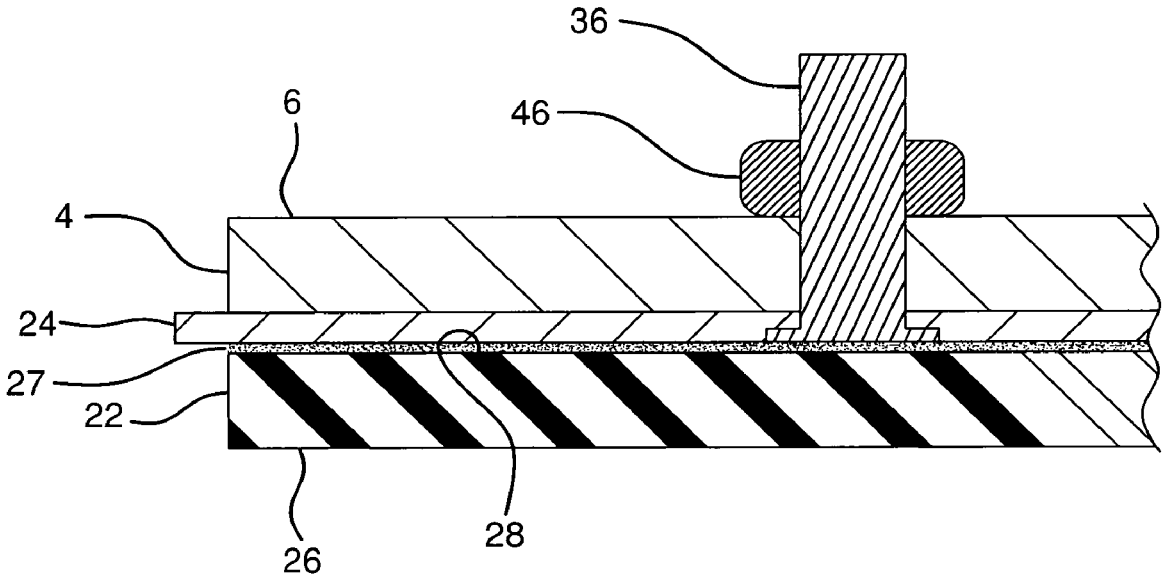
FIG. 3 is a partial sectional elevation view of the present invention.
Figure 4:
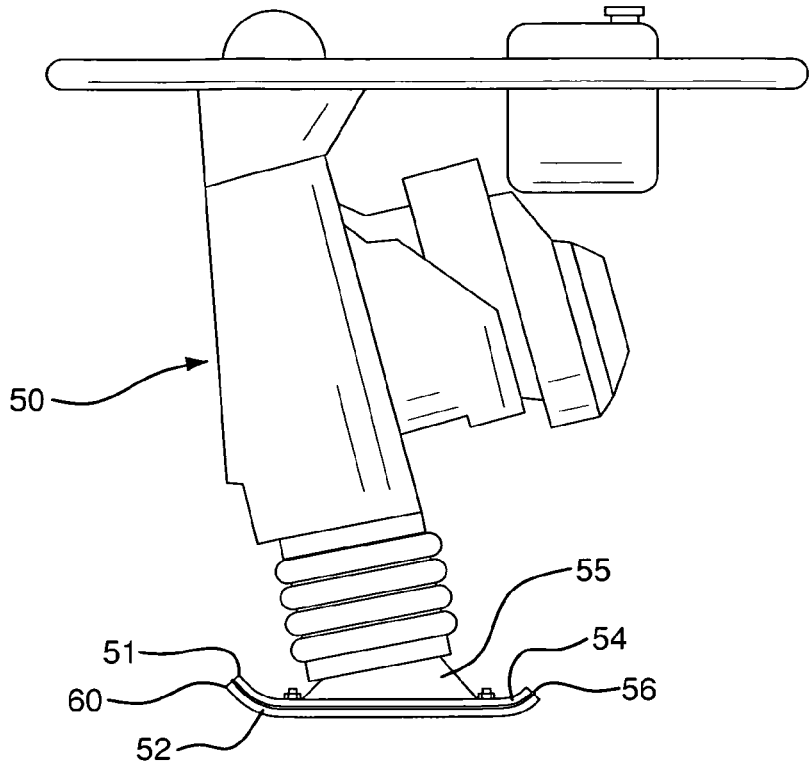
FIG. 4 is an elevation view of a powered tamper used with the present invention.
Figure 5:
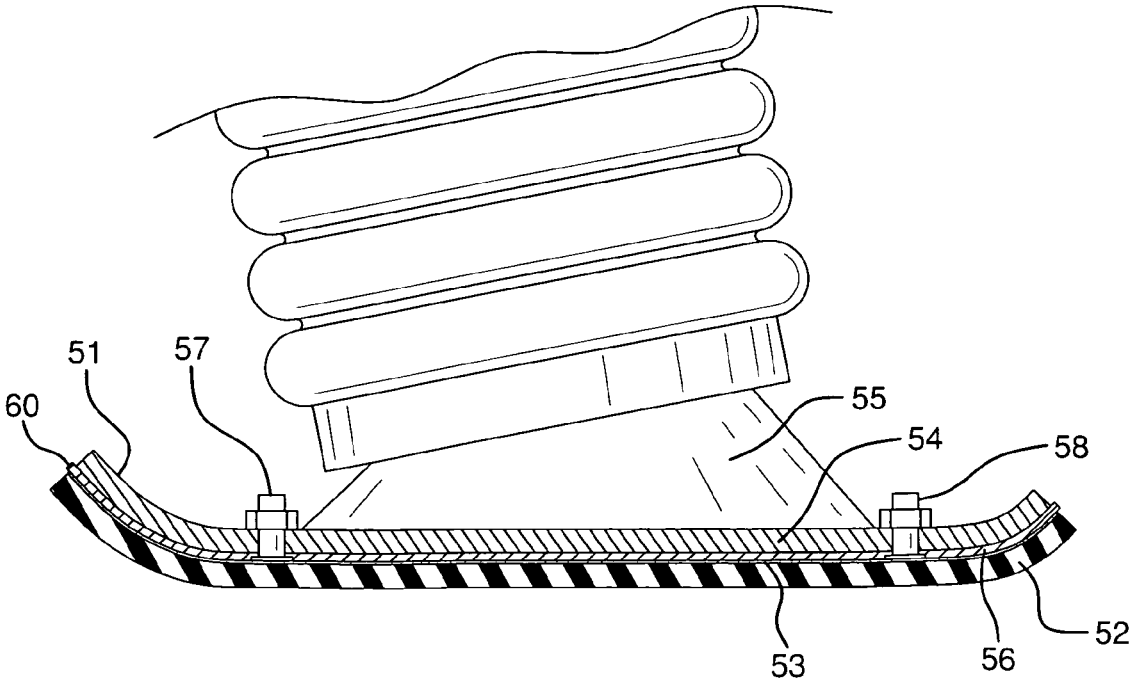
FIG. 5 is a close-up elevation view of the lower end of a powered tamper used with the present invention.

As seen in FIGS. 4 and 5, powered tamper 50 has lower base section 51, comprising mounting plate 54 secured to base support 55, similar in concept to the attachment of mounting plate 4 to support 5 of tamper tool 1. Base section 51 also comprises separable head assembly 60 comprising rubber pad 52 bonded with suitable adhesive 53 to backing plate 56. Head assembly 60 is removeably attached to mounting plate 54 by bolts 57 and 58 extending from backing plate 56, through openings in the mounting plate, similar to that which is shown with regard to the tamper tool in FIGS. 2 and 3.

The tamper tools of the present invention thus eliminate the need to replace an entire tool or an expensive component of the tool when only its working face becomes worn out. A new, fresh tool head assembly can be used which easily and quickly will replace the old, worn tool head assembly. The new tool head assembly also effectively, efficiently and safely provides a means to continue the tamping operation with little downtime and undue expense.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A tamper tool comprising:

a mounting plate having a top surface and a bottom surface;

support means secured to and extending up from the top surface of the mounting plate for raising and lowering the mounting plate over a ground surface;

a tool head assembly separable from and independent of the mounting plate, said tool head assembly comprising resilient pad means for tamping the ground surface upon raising and lowering of the mounting plate, said pad means having an upper surface, the tool head assembly further comprising a backing plate to which the pad means is permanently bonded, the backing plate overlaying and being bonded to the entire upper surface of the pad means; and connection means for removeably attaching the tool head assembly directly to the bottom surface of the mounting plate, the connection means extending from the pad means through the backing plate to form a non-permanent, removeable connection between the mounting plate and the tool head assembly, whereby upon disconnection of the connection means, the tool head assembly is removeably separated from and independent of the mounting plate.

2. The tamper tool as in claim 1 wherein the mounting plate is a flat plate.

3. The tamper tool as in claim 1 wherein the support means comprises a handle extending perpendicularly up from the mounting plate.

4. The tamper tool as in claim 1 wherein the connection means is permanently secured to and extends partially through the tool head assembly.

5. The tamper tool as in claim 1 wherein the connection means is permanently secured to the backing plate.

6. The tamper tool as in claim 5 wherein the connection means is configured to extend through openings in the mounting plate to secure the tool head assembly onto the bottom surface of the mounting plate by removeable connectors.

7. The tamper tool as in claim 1 wherein the pad means has a lower surface which is a flat, uninterrupted, planar surface.

8. The tamper tool as in claim 6 wherein the connection means comprises threaded bolts and the connectors comprise correspondingly threaded nuts.

9. A tamper tool comprising:

a mounting plate having a top surface and a bottom surface;

handle means immobily secured directly to and extending up from the top surface of the mounting plate for raising and lowering the mounting plate over a ground surface;

a tool head assembly separable from and independent of the mounting plate and handle means, said tool head assembly comprising resilient pad means for tamping the ground surface upon raising and lowering of the mounting plate, said pad means having an upper surface, the tool head assembly further comprising a backing plate to which the pad means is permanently bonded, the backing plate overlaying and being bonded to the entire upper surface of the pad means, and connection means extending from the pad means through the backing plate of the tool head assembly to form a non-permanent, removeable connection between the mounting plate and the tool head assembly; and attachment means for removeable engagement with the connection means to join the tool head assembly to the mounting plate, whereby upon disconnection of the attachment means from the connection means, the tool head assembly is removeable and becomes separable from and independent of the mounting plate for replacement of the tool head assembly with a second tool head assembly.

10. The tamper tool as in claim 9 wherein the mounting plate is a flat plate.

11. The tamper tool as in claim 9 wherein the handle means extends perpendicularly up from the mounting plate.

12. The tamper tool as in claim 9 wherein the connection means is permanently secured to and extends partially through the tool head assembly.

13. The tamper tool as in claim 9 wherein the connection means is permanently secured to the backing plate.

14. The tamper tool as in claim 9 wherein the connection means is configured to extend through openings in the mounting plate to secure the tool head assembly onto the bottom surface of the mounting plate by the removeable attachment means.

15. The tamper tool as in claim 9 wherein the pad means has a lower surface which is a flat, uninterrupted, planar surface.

16. The tamper tool as in claim 9 wherein the connection means comprises threaded bolts and the attachment means comprises correspondingly threaded nuts.

* * * * *